US007069856B2

(12) United States Patent
Hartka et al.

(10) Patent No.: US 7,069,856 B2
(45) Date of Patent: Jul. 4, 2006

(54) METHOD AND APPARATUS FOR MANAGING BOX-FINISHING MACHINE

(75) Inventors: Theodore Hartka, Phoenix, MD (US); Louis M. Sardella, Hunt Valley, MD (US)

(73) Assignee: Sun Automation, Inc., Sparks, MD (US)

( * ) Notice: Subject to any disclaimer, the term of this patent is extended or adjusted under 35 U.S.C. 154(b) by 0 days.

(21) Appl. No.: 10/845,606

(22) Filed: May 13, 2004

(65) Prior Publication Data

US 2005/0252396 A1 Nov. 17, 2005

(51) Int. Cl.
*B41F 33/00* (2006.01)

(52) U.S. Cl. ..... 101/483; 101/481; 101/486

(58) Field of Classification Search ..... 101/483, 101/486, 481
See application file for complete search history.

(56) References Cited

U.S. PATENT DOCUMENTS

| | | | | |
|---|---|---|---|---|
| 5,752,445 | A * | 5/1998 | Ruggiero et al. | 101/486 |
| 6,057,930 | A * | 5/2000 | Blossey et al. | 358/1.15 |
| 6,108,492 | A * | 8/2000 | Miyachi | 358/1.15 |
| 2005/0027714 | A1 * | 2/2005 | Kline | 707/100 |

FOREIGN PATENT DOCUMENTS

JP 2004-759654 * 10/2004

* cited by examiner

*Primary Examiner*—Daniel J. Colilla
*Assistant Examiner*—Marissa Ferguson-Samreth
(74) *Attorney, Agent, or Firm*—William E. Mouzavire

(57) ABSTRACT

A computer network is used to manage and monitor operation of a box-finishing machine which prints information on and cuts or creases corrugated boards to be formed into boxes. The equipment used on the machine is provided with radio frequency information tags detected by an electronic reader which transmits the identification to a computer so that it can be determined by an operator that sufficient equipment is in storage and staging areas for use on the machine. Several computer terminals are provided at different areas throughout a plant so that access is easily provided to different personnel.

16 Claims, 2 Drawing Sheets

METHOD AND APPARATUS FOR MANAGING BOX-FINISHING MACHINE

INTRODUCTION

Figure 1:
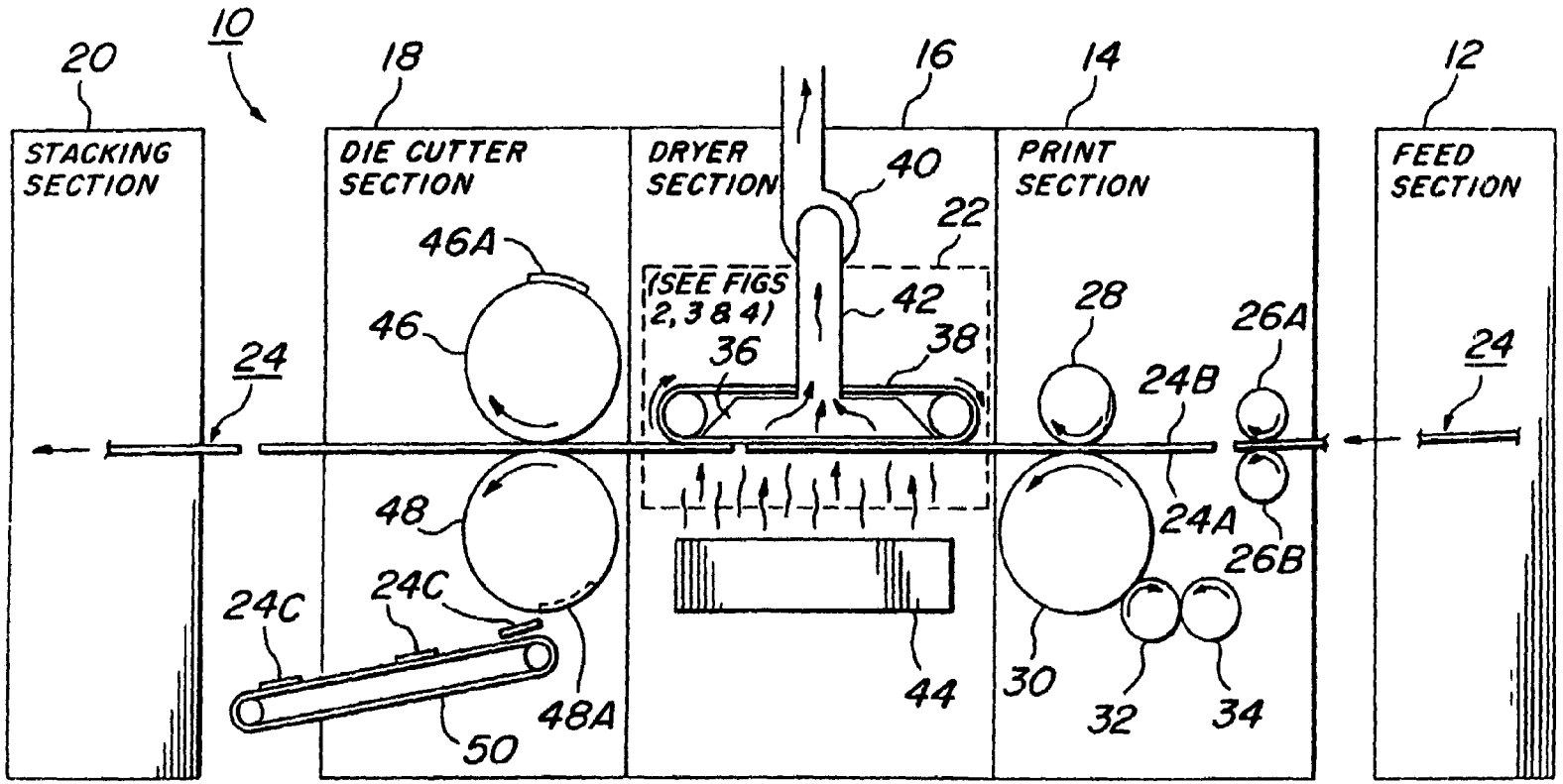

The present invention generally relates to corrugated box plants and more specifically to their finishing machines which print indicia on and cut, and/or crease the corrugated boards which will form the boxes. Although the present invention is particularly suited to box plant finishing machines, it will have applicability elsewhere.

BACKGROUND OF THE PRESENT INVENTION

In the box making industry, after the corrugated boards are made such as by a corrugating machine, they go to a finishing machine where they are conveyed to a printing station where an inked printing roller prints the desired indicia on each board. The indicia can be for example the name or trademark of the goods to be contained in the box and other useful information. The boards are then conveyed to another station where the board is cut and creased to later facilitate forming the blanks into boxes or other corrugated products. The blanks may also be folded and glued to form flattened boxes. The boards are then typically discharged into a stacker and strapped for shipment to the point of use.

Although finishing machines may be rated to run at ten thousand (10,000) boxes an hour, in reality they run at far less, for example, less than forty percent of their capacity or less than four thousand (4,000) boxes per hour. Various factors combine to result in this low efficiency. They often include the lack of proper supplies at the machine such as printing ink, printing plates, cutting dies, die bolts, plate mounting bands, tools, ink viscosity measuring devices, ink chemistry materials, etc. which must be applied or used in each job. In some cases the supplies, even if correct, are not brought to the machine in time. The result is that productivity is substantially reduced and the cost of manufacture is of course substantially increased. Moreover, many present box plants do not have any structured system for notifying a supervisor during a production run that the run is behind or will fall behind schedule. Even though training courses have been given to operators of the finishing machines to teach them the requirements for efficient operation, the reality is that many machines still run well below their capabilities.

OBJECTS OF THE PRESENT INVENTION

A main object of the present invention is to improve the productivity of finishing machines in a corrugated box plant. Included herein is the provision of novel methods and apparatus for improving the productivity of a finishing machine in a corrugated box plant.

A further object of the present invention is to provide novel methods and apparatus for managing and monitoring the progress of a box-finishing machine to enable corrective action in the event of a slow down in production. Included herein is the provision of novel methods and apparatus for indicating when certain supplies and equipment are not in place for use in a box-finishing machine.

Another object of the present invention is to provide a novel system including a computer network for managing and monitoring the operation of a box-finishing machine.

SUMMARY OF PREFERRED EMBODIMENT OF THE PRESENT INVENTION

In its preferred form, the present invention is embodied in a system for managing and monitoring a finishing machine in a corrugated box plant where sequential operations like printing and slotting and/or creasing are sequentially performed on corrugated boards at several stations along a path of travel. The system includes a computer having a program for scheduling each of the box-finishing jobs to be sequentially performed throughout a period, for example a day. The computer has another program for monitoring the progress of a job being run on the machine and whether or not various supplies and equipment are in place ready to be used when a job is to be run on the machine. The materials or equipment required to run a particular job can be divided into two categories. First are those items which are specific to the job (materials). This could include:

Printing plates
Cutting die
Inks
Corrugated blanks

A second category are tools and supplies that can be needed on any job (supplies). These could include:

Printing plate mounting bands
Cutting die mounting bolts
Wrenches
Ink viscosity and pH measuring devices
Ink chemistry maintenance materials
Cutting die repair materials It is also necessary to supply specifications as to the operations the machine is to perform on the blank (specifications). These include:

Location and size of slots and scores on the blank
List of the needed materials
Expected set-up time and run speed Most of this information is often included in the machines' set-up computer.

The containers of printing ink and the printing plates needed for the job are each provided with identification devices such as radio frequency identification devices (RFIDs) or radio frequency identification tags (hereinafter "RFIT") whose signals are received by electronic readers that pass the information contained in the RFIT to the computer. The needed cutting dies at the staging area are similarly monitored by RFITs fixed to each of the dies to transmit to one or more readers communicating with the computer. The program can then compare the materials at the staging area with those required by upcoming jobs. If the proper materials are not in place at a predetermined time before the job is to be set-up, those responsible for getting the materials in place and/or a supervisor would be notified so that remedial action can be taken before the materials are needed. Such notification could take many forms such as pop-up boxes on computer terminals, beeper messages or flashing lights.

Supplies are provided in a storage area adjacent the machine for ready inspection and use by the operator.

Before the beginning of a shift, an operator or supervisor will inspect the supply storage area and make an entry into the computer indicating that the needed supplies are in place or that certain supplies are missing and are needed. A card or bar code reader or a RFIT worn by the person would identify the person and send this information to the computer so that the person's identity would be known to and accessible from the computer. If any supplies are missing or absent from the supply area, the operator or persons responsible for maintaining the stock of supplies can correct it before the shift starts. Once corrected he would make through a terminal at the storage area or elsewhere, an entry into the computer indicating the needed supplies are in place and the time of his entry. Certain materials such as cutting dies and printing plates are re-used whenever the particular job is run. The person having responsibility for maintaining the printing plates and cutting dies would make an entry into the computer indicating that the parts have been inspected and found in order or the parts were repaired after each use. The time of inspection and repair would also be entered in the computer. This information would be combined with the information from RFITs to ensure that the tooling is in good order before the job is to be run. The computer program would also give the computer the capability of recording the time when equipment or supplies are first brought to or removed from storage and staging areas and/or the finishing machine.

Since the computer would have information on the job that is running and on the job to be set up, it would know the time expected for various set-up steps. Because of the RFITs used, it would know when the printing plate, ink and cutting dies were removed from the staging area indicating the beginning of each step of the set-up. It would know when the wash-up cycle was initiated from the machine. With this information, it could alert the operator when he or she should be finishing various steps. If the set-up, or even a set-up step was taking much longer than anticipated, the system would alert a supervisor and/or manager through computer screen pop-ups, large blinking lights over the machine and/or through a pager like device. This would allow immediate attention to determine the problem. Similarly, the expected running speed for the job would be in the computer record and if the machine were running significantly slower than that, or experiencing frequent stoppages, a similar warning would be issued. In addition to providing prompts for employees to do what is necessary to run the machine efficiently, the computer system would also be used to record all relevant events and provide documentation of performance for management.

DRAWINGS

Figure 2:
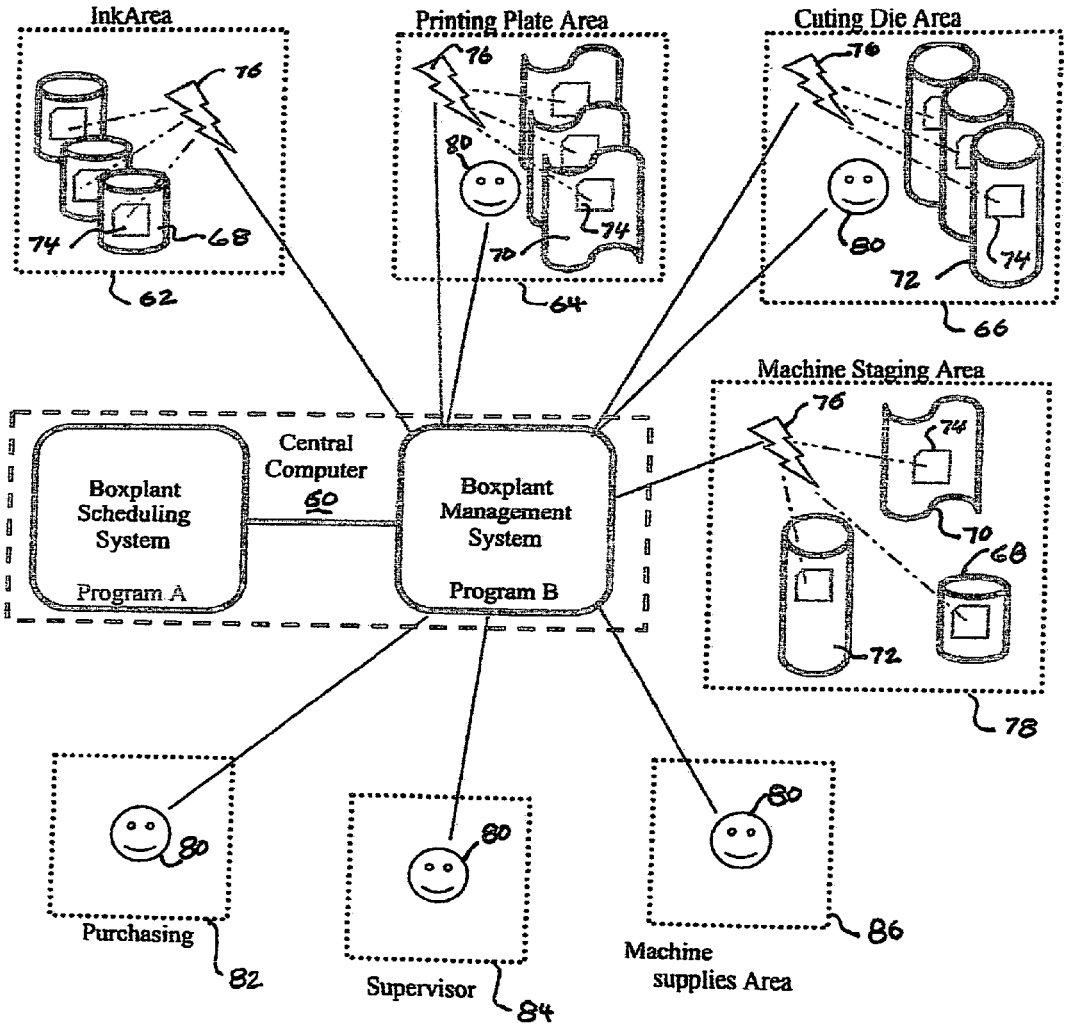

Other objects and advantages of the present inventions will become apparent from the following more detailed description taken in conjunction with the attached drawings in which:

FIG. 1 is a side, elevational view of a finishing machine for corrugated board; and FIG. 2 is a schematic view of a system for managing a finishing machine for corrugated board produced in a box plant.

DETAILED DESCRIPTION

Referring to the drawings in detail there is shown in FIG. 1 for illustrative purposes only, a finishing machine for corrugated boards used to form boxes in industry. The machine includes inlet pull rolls 26A 26B for sequentially receiving corrugated boards 24 from any suitable feeder (not shown) and delivering the boards to a print station 14 including a print impression roller 28 and a printer roller 30. The impression roller 28 contacts the upper surface of the boards 24 and the printer roller 30 contacts the lower surface.

The printer roller 30 cooperates with an ink roller 32 which, in turn, cooperates with a doctor roller 34 so that predetermined printed matter is placed on the bottom surface 24A of the box blank 24. The box blank 24, having printed matter on its bottom surface 24A, is moved out of printer station 14, and into dryer section 16 by means of the counter-rotating impression roller 28 and printer roller 30.

The die cutting section 18 comprises cutting die roller 46 and anvil roller 48 which come together so as to form cutout hand holes, tabs, and the like in the box blank 24. The cutting die 46 contacts the top surface 24B of the box blank, whereas the anvil roller contacts the bottom surface 24A of the box blank 24. The cutting die 46 has projection 46A which comes down onto the top surface 24B where it mates with the anvil 48 which provides a solid support surface directly positioned under the bottom surface 24A of the box blank 24. Projection 46A has a shape corresponding to the desired shape of the cutout being formed, whereas the anvil roller 48 has a penetrable surface, commonly provided by removable covers, to allow penetration of the projection 46A. The counter-rotating cutting die roller and anvil roller move the box blank 24, into the stacking section 20, where a stack of boxes is formed while the cutout 24C is removed onto conveyor 50. The stacked boxes are moved on and later exit the machine.

Referring to FIG. 2 there is shown a preferred system of the present invention for managing the operations of the finishing machine of FIG. 1. The system includes a main computer 60 having a program A for scheduling the various jobs to be performed throughout a given period, for example a day period. The program would also include the scheduled time duration for each of the jobs as well as the specifications including the identifications of the stock (corrugated boards) including the size, the printing ink, the printing plates and the cutting dies for each job.

Storage areas 62, 64 and 66 are provided for the printing inks 68, printing plates 70 and cutting dies 72. Each of these items is provided with an identification tag 74 such as a RFIT. In addition a reader 76 including an antenna is provided at each storage area to receive a signal from the RFIT 68 to indicate the presence of these items. This information is conveyed to a receiver connected to or integrated in the computer so that a program can determine from the computer the status of the inventory at each of the storage areas 62, 64 and 66. In addition, computers or computer terminals 80 in communication with central computer 60 are provided at the printing plate and cutting die storage areas 64 and 66 (as shown in FIG. 2) to enable workmen to easily access or add information to the central computer 60. Similarly, computer terminals 80 may also be provided at the ink and staging areas 62 and 78 and at various other locations such as in the purchasing area 82, supervisor's office 84 and area 86 where incidental supplies are stored as well as any station along the finishing machine. These terminals 80 can be inputted to add information to or obtain information from the computer network. Supplies typically maintained at station 86 would include printing plate mounting bands for holding the printing plates on printing rollers, cutting die bolts for securing the cutting dies on the die cylinders or rollers; cleaning brushes, ink viscosity measuring devices, ink chemistry materials, tools and cleaning rags.

When a job is entered into the schedule, the program checks that the proper ink, printing plates and cutting dies are in storage by interrogating the store rooms through the RFITs and readers 76. Through the records of other jobs scheduled, the program can determine if these items are in use on other jobs. If the materials are neither in the stockroom or in use on other jobs, the program alerts the person responsible to obtain the needed materials. In plants with corrugators, the supply of board is often handled through a specialized computer program which can provide the finishing department program with information about the supply of board without using the RFIT system. The computer program can then check the storage areas 62, 64, 66 to see if there are adequate supplies of ink, printing plates and cutting dies to cover the scheduled jobs. He would then check the incidental supplies area 86 that someone has verified that there were enough of those supplies to cover the scheduled jobs. If the supplies were deficient they would be corrected and the antennas at the storage areas 62, 64, 66 and staging areas 78 would transmit this correction to the computer 60.

Before a job was scheduled to begin, the computer program would check the staging area 78 to make sure that the necessary ink 68, printing plates 70 and dies 72 are ready to be applied to the machine. Once it was determined that sufficient supplies were present in the storage areas and that the necessary materials were at the staging area 78, the operator would commence the job. In addition, if the job being run on the machine is taking too long or is being interrupted the computer will trigger a signal or alarm to enable corrective action to be taken. In this regard, the computer will have all the information needed to determine whether the problem is one of lack of supplies or supplies that have not been deployed in time.

Any suitable, preferably high frequency, RFID system may be employed in carrying out the present invention, one such system being shown by way of example in U.S. Pat. No. 6,448,886 whose disclosure is hereby incorporated herein by reference. A typical system may include an integrated circuit including a reader 76 that sends a digital signal to a transceiver which generates radio frequency signals that are transmitted by a dipole antenna. The RDIT 74 has a dipole antenna across which a potential difference is generated by the electric field of the radio frequency signals generated by the reader's transceiver. The potential differences across the RFIT antenna causes a current to flow into a capacitor in the RFIT and the resulting charge is trapped there by a diode. The voltage across the capacitor turns on the RFIT's integrated circuit which sends out its unique identifier code as a series of digital high and low level signals that activate a transistor and are detected by the reader's transceiver which relays them to the integrated circuit where the RFIT's unique identification is determined and passed into the computer.

Although a preferred embodiment of the invention has been shown and described above, it will be appreciated by those of ordinary skill in the art that various modifications and adaptations of the invention may be made but without departure from the scope of the present invention indicated in the appended claims.

We claim:

1. In combination with a box finishing machine having a printer for printing information on boards processed by the machine, and a die for cutting or scoring the boards, and a designated staging area for receiving a cutting die, printing plate and printing an ink container prior to being placed in position on the machine for use on the machine; a system for monitoring the presence of at least one of a cutting die, printing plate, and printing ink container at the staging area for use in the machine, at least one of said cutting die, printing plate and printing ink container having electronic indicia means for responding to electronic signals and producing an electronic code signal, an electronic reader aimed at the staging area for receiving the code signals, and means including a computer for receiving the signals from the reader and recording the presence of at least one of said cutting die, printing plate and printing ink container at the staging area.

2. The combination defined in claim 1, further including a cutting die, printing plate and printing ink container at said staging area and each having electronic indicia means for responding to electronic signals to be transmitted by said reader and for producing an electronic code signal.

3. The combination defined in claim 1 including a network of terminals at different locations and connected to the computer for accessing information relating to the presence of said one printing plate, cutting die and printing ink container at the staging area.

4. The combination defined in claim 1 including at least one storage area separate from said staging area for said ink container, printing plate and cutting die, and an electronic reader at said storage area for responding to electronic signals from indicia means on said one ink container, printing plate and cutting die located at said storage area.

5. The combination defined in claim 4 including a terminal at said storage area for inputting information into or receiving information from said computer.

6. The combination defined in claim 1 wherein said computer includes a program for scheduling different jobs to be run on said finishing machine and for indicating the time it should take to run each job on the machine and for alerting that a job being run on the machine is behind schedule.

7. The combination defined in claim 6 wherein said computer includes a program for indicating the specifications for each job to be run on the finishing machine including specifications of boards to be processed, and printing ink, printing plates and cutting dies to be used for each job.

8. The combination claimed in claim 7 including a network of terminals at different locations for accessing information from or inputting information into the computer.

9. The combination defined in claim 8 wherein said indicia includes radio frequency information tags.

10. The combination defined in claim 1 wherein said computer includes a program for indicating the specifications for each job to be run on the finishing machine including specifications of boards to be processed, and for indicating equipment including printing ink, printing plates and cutting dies to be used for each job, said equipment having electronic indicia for emitting electronic code signals to be received by the computer when the equipment is at the staging area, said computer having a program for alerting that equipment is not in place at the staging area.

11. The combination defined in claim 1 wherein said indicia includes radio frequency information tags.

12. A method of managing a box finishing machine which has a printer including a printing plate for printing information on boards processed by the machine, and a die for cutting or creasing the board; the steps comprising designating a staging area for receiving equipment prior to using the equipment on the machine, providing a computer having a program for scheduling the jobs to be run on the machine, providing the computer with a program for detecting the presence at said area of equipment needed for a job to be run on the machine, providing electronic signal-emitting indicia on the equipment, and providing electronic means aimed at said area for reading and transmitting a signal from the indicia to the computer whereby the computer will have information indicating whether or not the equipment is at said area.

13. The method defined in claim 12 wherein said indicia include radio frequency information tags, and said means for transmitting a signal from the indicia to the computer includes an electronic reader.

14. The method defined in claim 12 including the steps of storing the equipment at several storage areas spaced from the box finishing machine and said staging area and providing each storage area with an electronic reader for transmitting electronic signals from the equipment at those storage areas to the computer.

15. The method defined in claim 14 including the step of providing computer terminals at said storage areas for accessing or inputting information in the computer.

16. The method defined in claim 12 wherein said equipment includes printing ink containers, printing plates and cutting dies each having a radio frequency information tag.

* * * * *

UNITED STATES PATENT AND TRADEMARK OFFICE

CERTIFICATE OF CORRECTION

PATENT NO. : 7,069,856 B2
APPLICATION NO. : 10/845606
DATED : July 4, 2006
INVENTOR(S) : Theodore Hartka and Louis M. Sardella It is certified that error appears in the above-identified patent and that said Letters Patent is hereby corrected as shown below:

Col. 5, claim 1, fifth line, the word "an" has been deleted.

On the title page, item (74), the attorney's surname has been corrected to read --…..Mouzavires…..--.

Signed and Sealed this

Twenty-sixth Day of September, 2006

JON W. DUDAS
*Director of the United States Patent and Trademark Office*